United States Patent [19]

Mester

[11] 3,991,315

[45] Nov. 9, 1976

[54] X-RAY GENERATOR

[75] Inventor: Heinz Mester, Hamburg, Germany

[73] Assignee: U.S. Philips Corporation, New York, N.Y.

[22] Filed: Apr. 10, 1975

[21] Appl. No.: 566,731

[30] Foreign Application Priority Data

Apr. 11, 1974 Germany ..... 2417798

[52] U.S. Cl. ..... 250/413; 250/402

[51] Int. Cl.[2] ..... H05G 1/30

[58] Field of Search ..... 250/413, 412, 402

[56] References Cited

UNITED STATES PATENTS

| | | | |
|---|---|---|---|
| 2,545,247 | 3/1951 | Vingerltuets | 250/413 |
| 2,875,344 | 2/1959 | Grinerich | 250/413 |
| 3,038,998 | 6/1962 | Bryer et al. | 250/413 |
| 3,214,589 | 10/1965 | Teague | 250/413 |
| 3,513,314 | 5/1970 | Wright | 250/413 |
| 3,917,949 | 11/1975 | Winkler | 250/402 |

*Primary Examiner*—Harold A. Dixon
*Assistant Examiner*—Bruce C. Anderson
*Attorney, Agent, or Firm*—Frank R. Trifari; Ronald L. Drumheller

[57] ABSTRACT

A generator circuit for a rotary anode x-ray tube in which the anode (rotor) and the stator are maintained at the same D.C. level thereby permitting a smaller air gap between the rotor (anode) and stator, resulting in a faster run-up, and a quicker switch-over from fluoroscopic to exposure operation.

3 Claims, 1 Drawing Figure

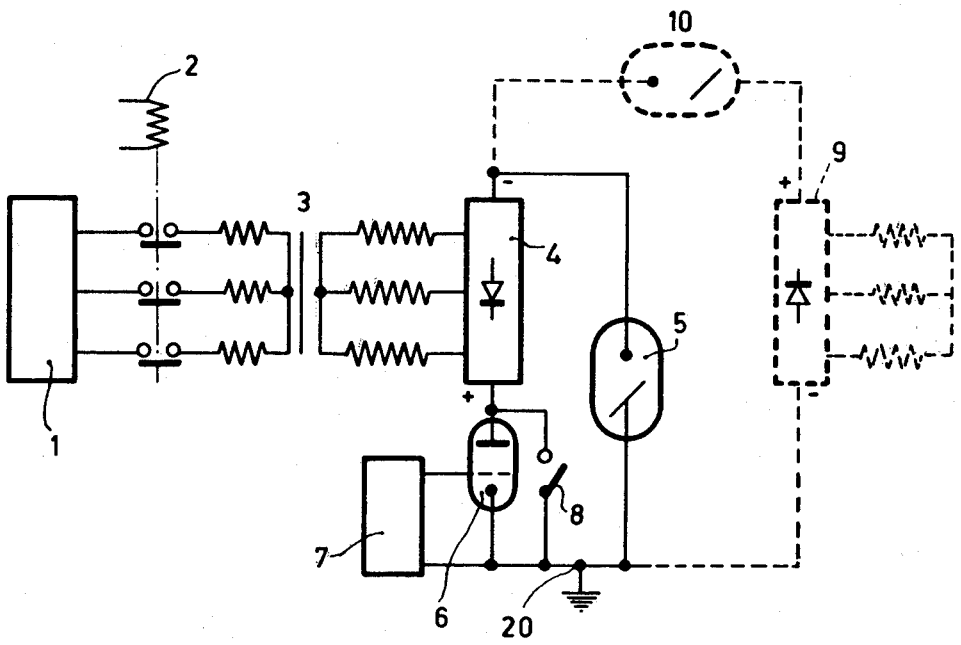
10
2
9
3
4
5
1
8
7
6
20

X-RAY GENERATOR

The invention relates to an X-ray installation, comprising a rotary anode X-ray tube and an X-ray generator, the X-ray tube and a high-voltage switching control tube being connected in series in the forward direction to a high-voltage generator.

An X-ray generator of this kind is known, for example, from "Electromedica" 4–5, 1973, page 178. Such X-ray generators offer a number of advantages over X-ray generators in which the high-voltage is switched and adjusted via a primary winding. For example, the X-radiation can be switched on and off substantially without delay, so that an X-ray generator of this kind can also be used for cine purposes at exposure frequencies of up to 50 images per second. The high voltage on the X-ray tube can also be very quickly changed (25 kV/ms) also during the exposure. An almost ideal direct voltage can be generated which is substantially independent of the mains voltage and of the instantaneous value of the current through the X-ray tube.

It is a drawback that — like in the conventional X-ray generators — the change-over from fluoroscopy to making exposures requires a comparatively long period of time. This delay is caused in that during this change-over the rotary anode must be accelerated from standstill (during fluoroscopy) to a speed required for exposure, for example, 3000 or 9000 revolutions per minute. As will be known, this acceleration takes so much time because a comparatively large air gap exists between a rotor, which is arranged inside the X-ray tube and which supports the rotary anode, and a stator which is arranged outside the X-ray tube, so that only a small part of the electric energy applied to the stator contributes to the acceleration of the rotor. During operation, the rotor is at anode potential in the known X-ray generator, i.e. at high voltage potential, while the stator has substantially earth potential. This large voltage difference imposes a definite lower limit with regards to the air gap in a rotary anode X-ray tube, or in other words with regard to the distance between rotor and stator.

The invention has for its object to realize an X-ray generator which incorporates on the one hand the described advantages and which, on the other hand, enables a fast change-over from fluoroscopy to making exposures.

In contemporary rotary anode X-ray tubes it is not possible to increase the electric power applied to the stator further without substantially increasing the dimensions thereof. Likewise, it is not possible to have the rotary anode operate at the speed necessary for making exposures already during fluoroscopy, because the continuous loading of the bearings of the rotary anode then occurring would have an adverse effect on the service life of the X-ray tube.

An X-ray installation of the kind set forth according to the invention is characterized in that the cathode side of the high-voltage switching/control tube and the anode side of the rotary anode X-ray tube are connected to a low voltage pole in the series circuit. The X-ray tube having a comparatively small air gap between rotor and stator.

The invention will be described in detail hereinafter with reference to a preferred embodiment as shown in the drawing.

The drawing diagrammatically shows an autotransformer 1 which can be connected to a three-phase a.c.

mains. On the secondary side of this transformer primary windings of a three-phase alternating current transformer 3 for generating a high voltage for the X-ray tube can be connected via contacts of a switch-on/off protection 2. The secondary windings of the three-phase alternating current transformer 3 are connected to a three-phase alternating current bridge rectifier 4. This three-phase alternating current bridge rectifier supplies a series connection of an X-ray tube 5 and a control triode 6, which serves for switching and controlling the high voltage, with only a low pulsating direct voltage. The cathode of the control triode 6 and the anode of the X-ray tube 5 are connected to a common circuit point 20 which is preferably earthed.

The following advantages are then obtained: the voltage between the control grid of the control triode 6 and earth corresponds to the voltage between grid and cathode of this control triode, and hence is comparatively low. The switching and control circuit 7, controlling the grid cathode voltage of the control triode 6, therefore, need not be isolated from high voltage. The same is applicable to the filament current circuit of the control triode 6.

Because the anode of the X-ray tube 5 is connected to earth, the rotor thereof is also connected to earth potential, so that no breakdowns will occur between rotor and stator, with the result that the air gap therebetween may be comparatively narrow. The inner diameter of the part of the envelope of the X-ray tube which encloses the rotor need only be slightly smaller than the rotor diameter for undisturbed rotation of the rotor. The stator can be slid directly, i.e. without insulating intermediate layers, onto the portion of the X-ray tube which encloses the rotor. This wall portion may be comparatively thin and need not necessary be an insulator. The air gap, i.e. the effective distance between rotor and stator, is then substantially smaller than in X-ray tubes having an anode which is loaded by half the high voltage or the full high voltage during operation. As a result, the useful part, of the electric power applied to the stator, i.e. the part used for driving the rotor, is substantially increased.

The potential on the two output terminals of three-phase alternating current bridge rectifier 4 floats, which means that the terminals have high voltage potential or a very low potential with respect to earth, depending on the state of the control triode and the filament current of the tube 5. Therefore, the secondary windings of the high voltage transformer 3 and the rectifiers in the three-phase alternating current bridge rectifier 4 must be insulated with respect to earth for the full operating voltage.

In the case of a failure of the control circuit 7 or of the control triode 6, further operation is possible if the switch 8, connected parallel to the anode-cathode path of the control triode 6, is closed. As is denoted by broken lines, a further three-phase alternating current bridge rectifier 9 may be provided which, in series with the three-phase alternating current bridge rectifier 4, supplies a high voltage (symmetrically with respect to earth) to an X-ray tube 10 connected between the three-phase alternating current bridge rectifiers instead of the X-ray tube 5; in such a case the air gap between the rotor and the stator of the X-ray tube 10 should be accordingly wider with respect to that in the X-ray tube 5.

The three-phase alternating current bridge rectifier 4 and the control triode 6 can be arranged in the same high voltage holders, possibly together with the three-phase alternating current bridge rectifier 9.

What is claimed is:

1. X-ray apparatus having a more rapid change-over from fluorescopic to exposure operation comprising a rotary anode x-ray tube having for more rapid rotor acceleration a gap between the rotor and stator thereof which is substantially smaller than the gap that would be required to prevent electrical breakdown if the voltage therebetween were equal to the high voltage applied between the anode and cathode of said x-ray tube and a circuit arrangement adapted to power said x-ray tube without causing a high voltage difference to be applied between the rotor and stator thereof, said circuit arrangement comprising:

a floating high voltage d.c. generator source for powering said x-ray tube, said floating source having a more positive terminal and a less positive terminal, said less positive terminal being electrically connected to the cathode of said x-ray tube;

a control tube having a cathode, an anode and a control grid, said anode of said control tube being electrically connected to said more positive terminal of said floating source and the anode and rotor of said x-ray tube and said cathode of said control tube being electrically grounded; and a control circuit electrically connected to said control grid of said control tube for controlling power applied to said x-ray tube.

2. X-ray apparatus as defined in claim 1 wherein said circuit arrangement further comprises a switch electrically connected between said cathode and anode of said control tube for operating said x-ray tube upon failure of said control tube or circuit.

3. X-ray apparatus as defined in claim 1 wherein said circuit arrangement further comprises an additional x-ray tube, the cathode thereof being electrically connected to said less positive terminal of said floating source, and a further high voltage d.c. generator source for powering said additional x-ray tube, said further source having a more positive terminal electrically connected to the anode of said additional x-ray tube and having a less positive electrode grounded.

* * * * *